US008807059B1

(12) United States Patent
Samples et al.

(10) Patent No.: US 8,807,059 B1
(45) Date of Patent: Aug. 19, 2014

(54) MARINE VESSELS AND SYSTEMS FOR LATERALLY MANEUVERING MARINE VESSELS

(75) Inventors: William J. Samples, Charleston, SC (US); Robert S. Mirman, Mt. Pleasant, SC (US); William R. Robertson, Oshkosh, WI (US); Kenneth G. Gable, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 249 days.

(21) Appl. No.: 13/227,578

(22) Filed: Sep. 8, 2011

(51) Int. Cl.
*B63H 20/00* (2006.01)
*B63H 20/12* (2006.01)
*B63H 25/42* (2006.01)

(52) U.S. Cl.
USPC ..... 114/144 R; 440/53; 701/21

(58) Field of Classification Search
CPC ..... B63H 20/00; B63H 20/12; B63H 20/16; B63H 20/20; B63H 2020/003; B63H 25/42; B63H 23/10; B63H 23/12; B63H 23/14; B63H 23/16; G05D 1/0206; G05D 1/0208
USPC ..... 114/144 R, 144 RE; 440/53, 84, 1; 701/21
See application file for complete search history.

(56) References Cited

U.S. PATENT DOCUMENTS

| | | | | |
|---|---|---|---|---|
| 6,234,853 | B1 | 5/2001 | Lanyi et al. | |
| 6,273,771 | B1 | 8/2001 | Buckley et al. | |
| 6,994,046 | B2 | 2/2006 | Kaji et al. | |
| 7,121,908 | B2 | 10/2006 | Okuyama | |
| 7,267,068 | B2 | 9/2007 | Bradley et al. | |
| 7,305,928 | B2 | 12/2007 | Bradley et al. | |
| 7,429,202 | B2 | 9/2008 | Yazaki et al. | |
| 7,467,595 | B1 | 12/2008 | Lanyi et al. | |
| 8,589,004 | B1 * | 11/2013 | Kanno | 701/21 |
| 2010/0191396 | A1 * | 7/2010 | Nose et al. | 701/21 |
| 2010/0191397 | A1 * | 7/2010 | Nose et al. | 701/21 |

* cited by examiner

*Primary Examiner* — Ajay Vasudeva
(74) *Attorney, Agent, or Firm* — Andrus Intellectual Property Law, LLP

(57) ABSTRACT

Systems for maneuvering a marine vessel comprise an input device for requesting lateral movement of the marine vessel with respect to the longitudinal axis and a plurality of propulsion devices including at least a port propulsion device, a starboard propulsion device and an intermediate propulsion device disposed between the port and starboard propulsion devices. A control circuit controls orientation of the port and starboard propulsion devices inwardly towards a common point on the marine vessel, and upon a request for lateral movement of from the input device, operates one of the port and starboard propulsion devices in forward gear, operates the other of the port and starboard propulsion devices in reverse gear, and operates the intermediate propulsion device in reverse gear.

20 Claims, 6 Drawing Sheets

MARINE VESSELS AND SYSTEMS FOR LATERALLY MANEUVERING MARINE VESSELS

FIELD

The present application relates to marine vessels and particularly to control systems for maneuvering marine vessels.

BACKGROUND

U.S. Pat. No. 6,234,853, which is hereby incorporated herein by reference in entirety, discloses a docking system which utilizes the marine propulsion unit of a marine vessel, under the control of an engine control unit that receives command signals from a joystick or push button device, to respond to a maneuver command from the marine operator. The docking system does not require additional propulsion devices other than those normally used to operate the marine vessel under normal conditions. The docking or maneuvering system uses two marine propulsion units to respond to an operator's command signal and allows the operator to select forward or reverse commands in combination with clockwise or counterclockwise rotational commands either in combination with each other or alone.

U.S. Pat. No. 7,267,068, which is hereby incorporated herein by reference in entirety, discloses a marine vessel maneuvered by independently rotating first and second marine propulsion devices about their respective steering axes in response to commands received from a manually operable control device, such as a joystick. The marine propulsion devices are aligned with their thrust vectors intersecting at a point on a centerline of the marine vessel and, when no rotational movement is commanded, at the center of gravity of the marine vessel. Internal combustion engines are provided to drive the marine propulsion devices. The steering axes of the two marine propulsion devices are generally vertical and parallel to each other. The two steering axes extend through a bottom surface of the hull of the marine vessel.

U.S. Pat. No. 7,305,928, which is hereby incorporated herein by reference in entirety, discloses a vessel positioning system that maneuvers a marine vessel in such a way that the vessel maintains its global position and heading in accordance with a desired position and heading selected by the operator of the marine vessel. When used in conjunction with a joystick, the operator of the marine vessel can place the system in a station keeping enabled mode and the system then maintains the desired position obtained upon the initial change in the joystick from an active mode to an inactive mode. In this way, the operator can selectively maneuver the marine vessel manually and, when the joystick is released, the vessel will maintain the position in which it was at the instant the operator stopped maneuvering it with the joystick.

U.S. Pat. No. 7,467,595, which is hereby incorporated herein by reference in entirety, discloses a method for controlling the movement of a marine vessel, which rotates one of a pair of marine propulsion devices and controls the thrust magnitudes of two marine propulsion devices. A joystick is provided to allow the operator of the marine vessel to select port-starboard, forward-reverse, and rotational direction commands that are interpreted by a controller which then changes the angular position of at least one of a pair of marine propulsion devices relative to its steering axis.

U.S. patent application Ser. No. 13/157,128, which is hereby incorporated herein by reference in entirety, discloses a system for maneuvering a marine vessel comprises an input device for requesting a reverse thrust of a marine propulsion device and a control circuit that, based upon the request for the reverse thrust from the input device, controls movement of the marine propulsion device into a trim position wherein the marine propulsion device provides a reverse thrust that is not impeded by a hull of the marine vessel. Optionally, the input device can comprise a joystick.

SUMMARY

The present disclosure results from research and development of systems for maneuvering marine vessels. The present inventors have determined that in systems having three or more propulsion devices located at the stern of the vessel, such as for example outboard engines, and particularly in systems having an odd number of such propulsion devices, responsivity of the systems to requests for lateral movement is often limited by the limited reverse thrust capabilities of one of the port or starboard propulsion devices. More specifically, upon a request for lateral movement of the marine vessel, which is input via for example a joystick, both port and starboard propulsion devices are typically turned inwardly towards a center of gravity or center of turn of the marine vessel. One of the port and starboard devices is operated in reverse gear and the other in forward gear, depending upon the direction of lateral movement that is requested. The intermediate device is placed in neutral gear. The port and starboard devices are then controlled to provide propulsive forces that together achieve a resultant thrust vector on the vessel in the direction of lateral movement that has been requested. However the inventors have found that because most propellers have less thrust capability in reverse than in forward, the relatively limited thrust capability of the reversely operating device limits the amount of thrust that can be provided by the forwardly operating device. That is, the system cannot utilize the maximum thrust capability of the forwardly operating device and still equalize the thrust vectors in the longitudinal direction to achieve the requested resultant lateral thrust vector. The same holds true for other types of propulsors, such as for example jets. The inventors therefore have realized this is an inefficient use of the capabilities of the propulsion devices and therefore a problem. Through experimentation, it has been found that prior art systems with these limitations often provide insufficient responsivity to requests for transverse movement, especially in situations where relatively large amounts of wind and/or waves are acting on the vessel in the lateral direction and it is desired to maintain a position of the marine vessel, or for example when a large amount of acceleration in the lateral direction is requested. The present disclosure provides examples of the inventors' solutions to these and other problems.

In one example, a system comprises an input device requesting lateral movement of the marine vessel with respect to the longitudinal axis and a plurality of propulsion devices including at least a port propulsion device, a starboard propulsion device and an intermediate propulsion device disposed between the port and starboard propulsion devices. A control circuit controls orientation of the port and starboard propulsion devices inwardly towards a common point on the marine vessel, and upon a request for lateral movement of from the input device, operates one of the port and starboard propulsion devices in forward gear, operates the other of the port and starboard propulsion devices in reverse gear, and operates the intermediate propulsion device in reverse gear.

In another example, a method for maneuvering a marine vessel comprises operating a control circuit to operate a plurality of propulsion devices comprising at least a port propulsion device, a starboard propulsion device and an intermediate propulsion device disposed between the port and starboard propulsion devices; requesting lateral movement of the marine vessel with respect to the longitudinal axis; orienting the port and starboard propulsion devices inwardly towards a common point; operating one of the port and starboard propulsion devices in forward gear; operating the other of the port and starboard propulsion devices in reverse gear; and operating the intermediate propulsion device in reverse gear.

Further examples, including but not limited to marine vessels and methods of operation for marine vessels are also disclosed.

DETAILED DESCRIPTION OF THE DRAWINGS

Figure 2:
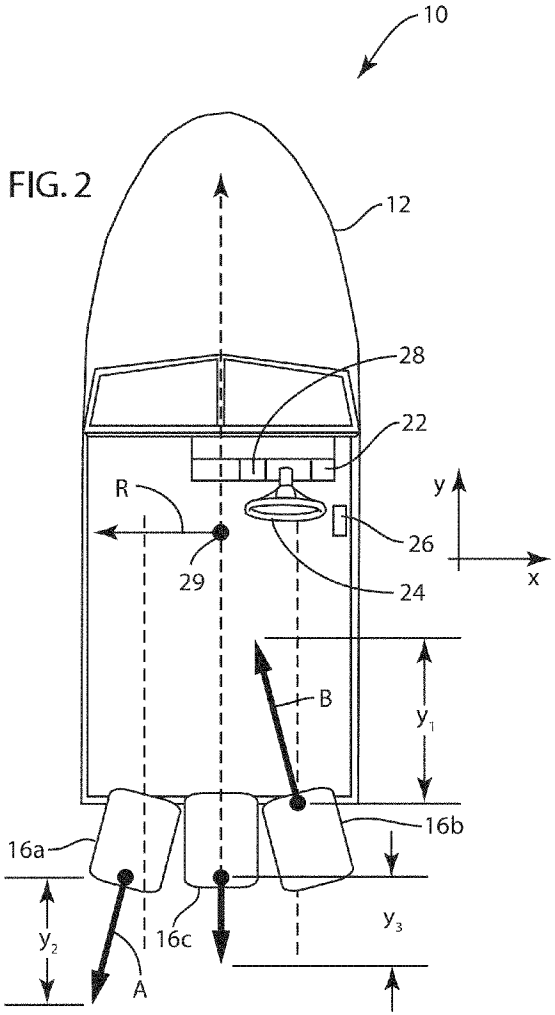
FIG. 2 is schematic depiction of a marine vessel having the plurality of marine propulsion devices wherein port and starboard propulsion devices are oriented inwardly towards a common point.

In the present disclosure, certain terms have been used for brevity, clearness and understanding. No unnecessary limitations are to be implied therefrom beyond the requirement of the prior art because such terms are used for descriptive purposes only and are intended to be broadly construed. The different systems and methods described herein may be used alone or in combination with other systems and devices. Various equivalents, alternatives and modifications are possible within the scope of the appended claims. Each limitation in the appended claims is intended to invoke interpretation under 35 U.S.C. §112, sixth paragraph only if the terms "means for" or "step for" are explicitly recited in the respective limitation.

FIGS. 1-6 depict components of a system 10 for maneuvering and orienting a marine vessel 12. The system 10 includes, among other things, a control circuit 14 (see FIG. 6) for controlling the rotational position, trim position, and thrust generation of a plurality of marine propulsion devices 16*a*, 16*b*, 16*c* based upon inputs from an input device. It should be understood that the particular configurations of the system 10 and marine vessel 12 are exemplary. It is possible to apply the concepts described in the present disclosure with substantially different configurations for systems for maneuvering and orienting marine vessels and with substantially different marine vessels.

For example, the control circuit 14 (see FIG. 6) is shown in simplified schematic form and has a plurality of command control sections (CCM) 18*a*, 18*b*, 18*c* located at a helm 19 of the marine vessel 12 that communicate with respective engine control sections 20*a*, 20*b*, 20*c* associated with each marine propulsion device 16*a*, 16*b*, 16*c*; steering control sections 21*a*, 21*b*, 21*c* associated with steering actuators 23*a*, 23*b*, 23*c* for steering each marine propulsion device 16*a*, 16*b*, 16*c*; and trim control sections 31*a*, 31*b*, 31*c*, associated with trim actuators 33*a*, 33*b*, 33*c* for changing the trim angles of each marine propulsion device 16*a*, 16*b*, 16*c*. However, the control circuit 14 can have any number of sections (including for example one section) and can be located remotely from or at different locations in the marine vessel 12 from that shown. For example, the trim control sections 31*a*, 31*b*, 31*c* can be co-located with and/or part of the engine control sections 20*a*, 20*b*, 20*c* (as shown); or can be located separately from the respective engine control sections 20*a*, 20*b*, 20*c*. Other similar modifications of this type can be made. It should also be understood that the concepts disclosed in the present disclosure are capable of being implemented with different types of control systems, including systems that acquire global position data and real time positioning data, such as for example global positioning systems, inertial measurement units, and/or the like.

Further, certain types of input devices such as a joystick 22, a steering wheel 24, a shift/throttle lever 26, and a keypad 28 are described. It should be understood that the present disclosure is applicable with other numbers and types of input devices such as video screens, touchscreens, voice command modules, and the like. It should also be understood that the concepts disclosed in the present disclosure are able to function in a preprogrammed format without user input or in conjunction with different types of input devices. as would be known to one of ordinary skill in the art. Further equivalents, alternatives and modifications are possible as would be recognized by one of ordinary skill in the art.

Further, a marine vessel 12 having three (i.e. port, intermediate and starboard) marine propulsion devices is described; however, the concepts of the present disclosure are applicable to marine vessels having any number of marine propulsion devices. Configurations with more than three marine propulsion devices are contemplated. Parts of this disclosure and claims refer to a "propulsion device". These descriptions are intended to equally apply to arrangements having "one or more propulsion devices." The concepts in the present disclosure are also applicable to marine vessels having any type or configuration of propulsion device, such as for example electric motors, internal combustion engines, and/or hybrid systems configured as an inboard drive, outboard drive, inboard/outboard drive, stern drive, and/or the like. The propulsion devices can include any different type of propulsor such as propellers, impellers, pod drives and/or the like.

Figure 1:
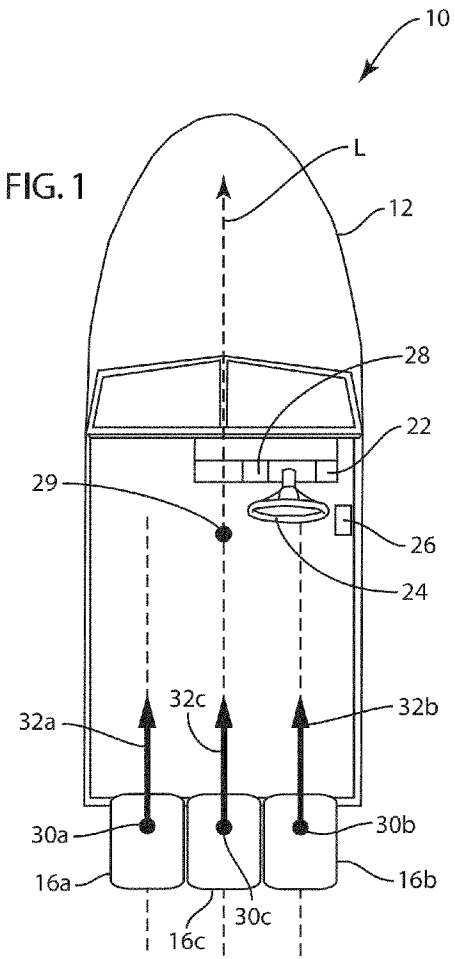
FIG. 1 is a schematic depiction of a marine vessel having a plurality of marine propulsion devices in an aligned position.

In FIGS. 1 and 2, a marine vessel 12 is schematically illustrated and has port, starboard and intermediate propulsion devices 16*a*, 16*b*, 16*c*, which in the example shown are outboard internal combustion engines. Again, the number of propulsion devices can vary from that shown. The intermediate propulsion device 16*c* is disposed between the port and starboard propulsion devices 16*a*, 16*b*. As used in this description and the appended claims, the term "disposed between" is to be given its broadest possible meaning, including arrangements wherein the intermediate propulsion device is located fore or aft of one or both of the port and starboard propulsion devices 16*a*, 16*b*. The term "disposed between" also includes arrangements wherein the intermediate propulsion device 16*c* is located at different elevation from the port and starboard devices 16*b*, 16*c*. The term "disposed between" also includes arrangements wherein the intermediate propulsion device 16*c* is located closer to one of the port and starboard devices 16*a*, 16*b* than the other of the port and starboard devices 16*a*, 16*b*. The marine propulsion devices 16*a*, 16*b*, 16*c* are each rotatable in clockwise and counterclockwise directions through a substantially similar range of rotation about respective steering axes 30*a*, 30*b*, 30*c*. As shown in FIG. 1, the steering axis 30*c* is located along the longitudinal axis, which is a longitudinal centerline of the marine vessel 12. Rotation of the marine propulsion devices 16*a*, 16*b*, 16*c* is facilitated by conventional steering actuators 23*a*, 23*b*, 23*c* (See FIG. 6). Steering actuators for rotating marine propulsion devices are well known in the art, examples of which are provided in U.S. Pat. No. 7,467,595, the disclosure of which is hereby incorporated by reference in entirety. Each marine propulsion device 16*a*, 16*b*, 16*c* creates propulsive thrust in both forward and reverse directions. FIG. 1 shows the marine propulsion devices 16*a*, 16*b*, 16*c* operating in forward gear, such that resultant forwardly acting thrust vectors 32*a*, 32*b*, 32*c* on the marine vessel 12 are produced; however, it should be recognized that the propulsion devices 16*a*, 16*b*, 16*c* could also be operated in reverse gear and thus provide oppositely oriented (reversely acting) thrust vectors on the vessel 12.

As shown in FIG. 1, the propulsion devices 16*a*, 16*b*, 16*c* are aligned in a longitudinal direction L to thereby define the thrust vectors 32*a*, 32*b*, 32*c* extending in the longitudinal direction L. The particular orientation shown in FIG. 1 is typically employed to achieve a forward or backward movement of the marine vessel 12 in the longitudinal direction L or a rotational movement of the vessel 12 with respect to the longitudinal direction L. Specifically, operation of the propulsion devices 16*a*, 16*b*, 16*c* in forward gear causes the marine vessel 12 to move forwardly in the longitudinal direction L. Conversely, operation of propulsion devices 16*a*, 16*b*, 16*c* in reverse gear causes the marine vessel 12 to move reversely in the longitudinal direction L. Further, operation of one of propulsion devices 16*a*, 16*b* in forward gear and the other in reverse gear causes rotation of the marine vessel 12 about a center of turn 29 for the marine vessel 12 and with respect to the longitudinal direction L. In this example intermediate propulsion device 16*b* is shifted into neutral gear. Various other maneuvering strategies and mechanisms are described in the incorporated U.S. Pat. Nos. 6,234,853; 7,267,068; and 7,467,595.

In this example, the center of turn 29 represents an effective center of gravity for the marine vessel 12. However it will be understood by those having ordinary skill in the art that the location of the center of turn 29 is not, in all cases, the actual center of gravity of the marine vessel 12. That is, the center of turn 29 can be located at a different location than the actual center of gravity that would be calculated by analyzing the weight distribution of various components of the marine vessel 12. Maneuvering a marine vessel 12 in a body of water results in reactive forces exerted against the hull of the marine vessel 12 by the wind and the water. For example, as various maneuvering thrusts are exerted by the marine propulsion devices 16*a*, 16*b*, 16*c*, the hull of the marine vessel 12 pushes against the water and the water exerts a reaction force against the hull. As a result, the center of turn identified at 29 in FIGS. 1 and 2 can change in response to different sets of forces and reactions exerted on the hull of the marine vessel 12. This concept is recognized by those skilled in the art and is referred to as the instantaneous center of turn in U.S. Pat. No. 6,234,853; and as the instantaneous center in U.S. Pat. No. 6,994,046.

As shown in FIG. 2, the marine propulsion devices 16*a* and 16*b* are rotated out of the aligned position shown in FIG. 1 so that the marine propulsion devices 16*a*, 16*b* and their resultant thrust vectors 32*a*, 32*b* are not aligned in the longitudinal direction L. In the example shown in FIG. 2, the marine propulsion devices 16*a*, 16*b* are splayed inwardly and operated so as to provide thrust vectors 32*a*, 32*b* that are aligned with a common point, which in this example is the center of turn 29. In addition to the example shown in FIG. 2, various other unaligned positions and relative different or the same amounts of thrust of the marine propulsion devices 16*a*, 16*b* are possible to achieve one or both of a rotational movement and movement of the marine vessel 12 in any direction, including laterally to and along the longitudinal direction L.

The marine vessel 12 also includes a helm 19 (see FIG. 6) where a user can input commands for maneuvering the marine vessel 12 via one or more input devices. As discussed above, the number and type of input devices can vary from the example shown. In FIGS. 1 and 2, the input devices include the joystick 22, steering wheel 24, shift and throttle lever 26 and keypad 28. Rotation of the steering wheel 24 in a clockwise direction requests clockwise rotation or yaw of the marine vessel 12 about the center of turn 29. Rotation of the steering wheel 24 in the counter-clockwise direction requests counterclockwise rotation or yaw of the marine vessel 12 about the center of turn 29. Forward pivoting of the shift and throttle lever 26 away from the neutral position requests forward gear and requests increased throttle. Rearward pivoting of the shift and throttle lever 26 away from a neutral position requests reverse gear and requests increasing rearward throttle. Actuation of the keypad 28 inputs user-requested operational mode selections to the control circuit 14, as will be discussed further herein below.

Figure 5:
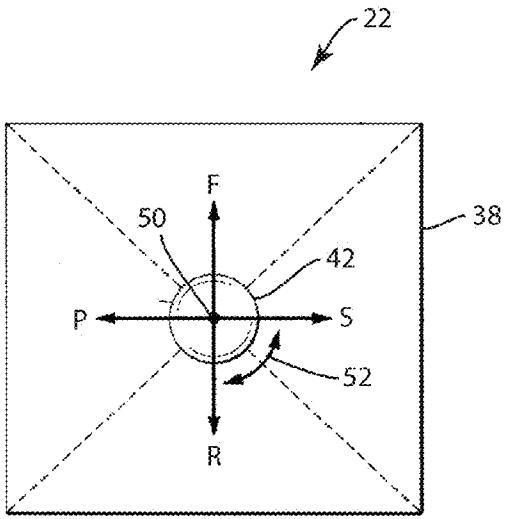
FIG. 5 is a top view of the joystick.
Figure 3:
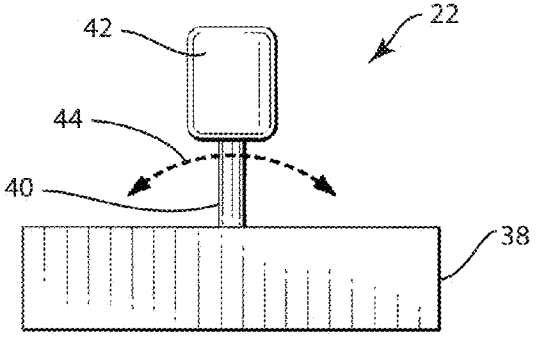
FIG. 3 is a side view of an input device in the form of a joystick.
Figure 4:
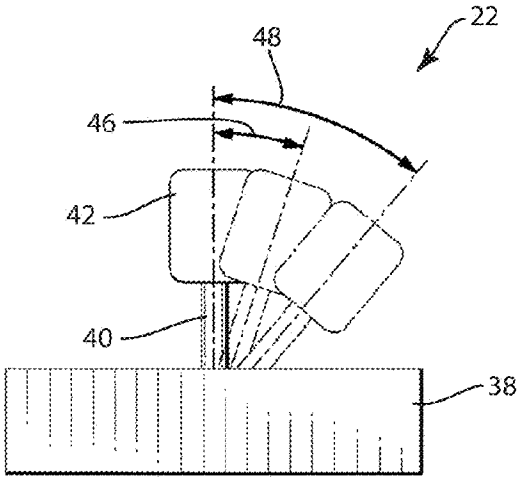
FIG. 4 is a view like FIG. 3 showing movement of the joystick.

A schematic depiction of a joystick 22 is depicted in FIGS. 3-5. The joystick 22 includes a base 38, a shaft 40 extending vertically upwardly relative to the base 38, and a handle 42 located on top of the shaft 40. The shaft 40 is movable, as represented by dashed-line arrow 44 in numerous directions relative to the base 38. FIG. 4 illustrates the shaft 40 and handle 42 in three different positions which vary by the magnitude of angular movement. Arrows 46 and 48 show different magnitudes of movement. The degree and direction of movement away from the generally vertical position shown in FIG. 3 represents an analogous magnitude and direction of an actual movement command selected by a user. FIG. 5 is a top view of the joystick 22 in which the handle 42 is in a central, vertical, or neutral position. The handle 42 can be manually manipulated in a forward F, reverse R, port P or starboard S direction or a combination of these to provide actual movement commands into F, R, P, S directions or any other direction therebetween. In addition, the handle 42 can be rotated about the centerline 50 of the shaft 40 as represented by arrow 52 to request rotational movement or yaw of the vessel 12 about the center of turn 29. Clockwise rotation of the handle 42 requests clockwise rotation of the marine vessel 12 about the center of turn 29, whereas counterclockwise rotation of the handle 42 requests counterclockwise rotation of the vessel about the center of turn 29. Various other joystick structures and operations are described in the incorporated U.S. Pat. Nos. 6,234,853; 7,267,068; and 7,467,595.

Figure 6:
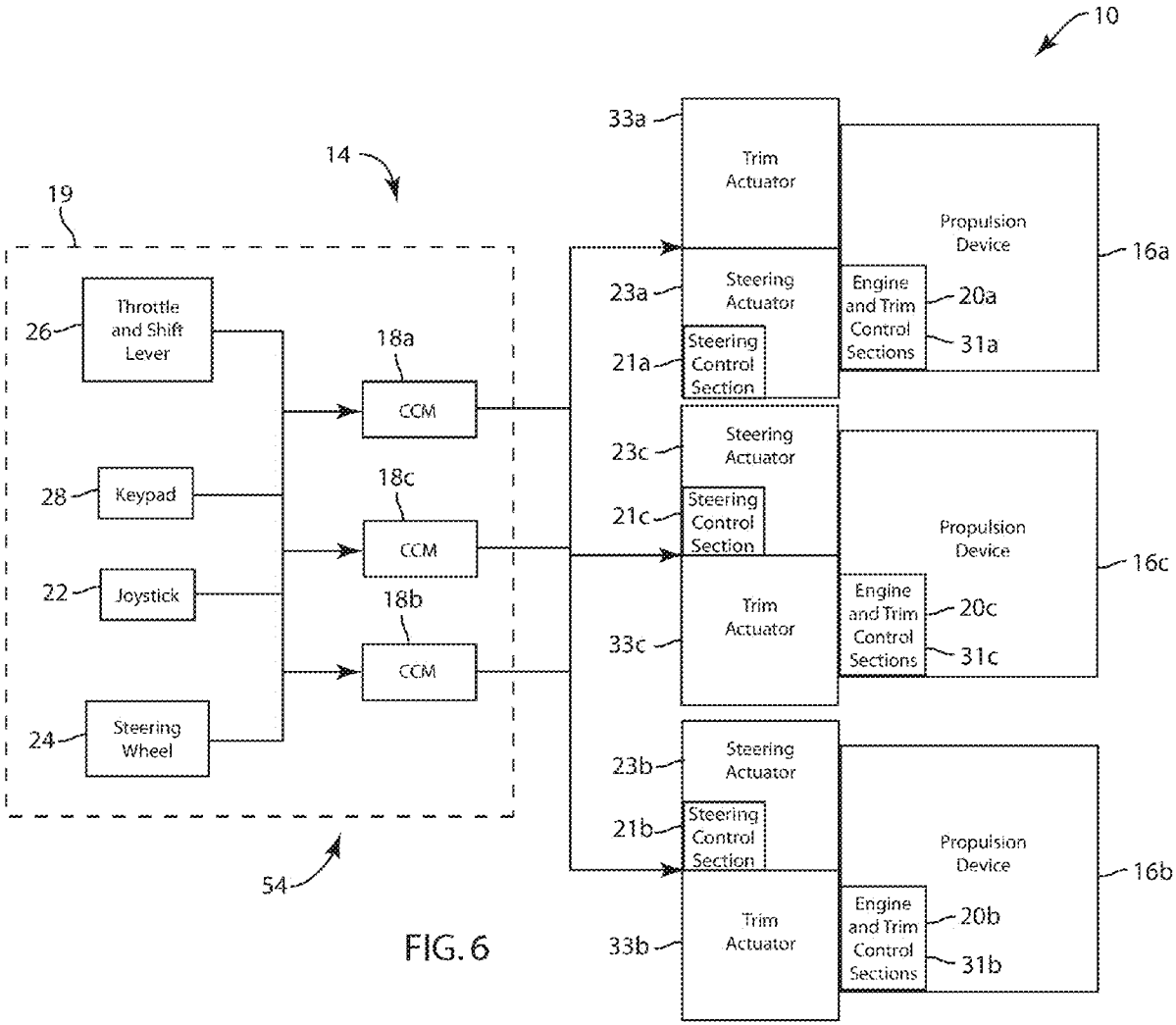
FIG. 6 is a schematic depiction of a control circuit for controlling a plurality of marine propulsion devices.

Referring to FIG. 6 the input devices 22, 24, 26 and 28 communicate with the control circuit 14, which in the example shown is part of a control circuit area network 54. It is not required that the input devices 22, 24, 26 and 28 communicate with the control circuit 14 via the control circuit area network 54. For example, one or more of these items can be connected to the control circuit by hard wire or wireless connection. The control circuit is programmed to control operation of marine propulsion devices 16*a*, 16*b*, 16*c* and the steering actuators and trim actuators associated therewith. As discussed above, the control circuit 14 can have different forms. In the example shown, the control circuit 14 includes a plurality of command control sections 18*a*, 18*b*, 18*c* located at the helm 19. A command control section 18*a*, 18*b*, 18*c* is provided for each of the port, starboard and intermediate marine propulsion devices 16*a*, 16*b*, 16*c*. The control circuit 14 also includes engine control sections 20*a*, 20*b*, 20*c* located at and controlling operation of each respective propulsion device 16*a*, 16*b*, 16*c*, a steering control section 21*a*, 21*b*, 21*c* located at and controlling operation of each steering actuator 23*a*, 23*b*, 23*c*, and a trim control section 31*a*, 31*b*, 31*c* located at the respective engine control sections 20*a*, 20*b*, 20*c* and controlling operation of each trim actuator 33*a*, 33*b*, 33*c*. In another example, the trim control sections 31*a*, 31*b*, 31*c* can be located apart from the engine control sections 20*a*, 20*b*, 20*c*, respectively. Each control section has a memory and a processor for sending and receiving electronic control signals, for communicating with other control circuits in the control circuit area network 54, and for controlling operations of certain components in the system 10 such as the operation and positioning of marine propulsion devices and related steering actuators and trim actuators. Examples of the programming and operations of the control circuit 14 and its sections are described in further detail below with respect to non-limiting examples and/or algorithms. While each of these examples/algorithms includes a specific series of steps for accomplishing certain system control functions, the scope of this disclosure is not intended to be bound by the literal order or literal content of steps described herein, and non-substantial differences or changes still fall within the scope of the disclosure.

In the example shown, each command control section 18*a*, 18*b*, 18*c* receives user inputs via the control circuit area network 54 from the joystick 22, steering wheel 24, shift and throttle lever 26, and keypad 28. As stated above, the joystick 22, steering wheel 24, shift and throttle lever 26, and keypad 28 could instead by wired directly to the CCM 18*a*, 18*b*, 18*c* instead of via the control circuit area network 54. Each command control section 18*a*, 18*b*, 18*c* is programmed to convert the user inputs into electronic commands and then send the commands to other control circuit sections in the system 10, including the engine control sections 20*a*, 20*b*, 20*c* and related steering control sections and trim control sections. For example, when the shift and throttle lever 26 is actuated, as described above, each command control section 18*a*, 18*b*, 18*c* sends commands to the respective engine control sections 20*a*, 20*b*, 20*c* to achieve the requested change in throttle and/or shift. Rotation of the shift and throttle lever in the aftward direction will request reverse shift and thrust of the marine propulsion devices 16*a*, 16*b*, 16*c* to achieve reverse movement of the marine vessel 12. Further, when the steering wheel 24 is actuated, as described above, each command control section 18*a*, 18*b*, 18*c* sends commands to the respective steering control sections 21*a*, 21*b*, 21*c* to achieve the requested change in steering. When the joystick 22 is moved out of its vertical position, each command control section 18*a*, 18*b*, 18*c* sends commands to the respective engine control sections 20*a*, 20*b*, 20*c* and/or steering control sections 21*a*, 21*b*, 21*c* to achieve a movement commensurate with the joystick 22 movement. When the handle 42 of the joystick 22 is rotated, each command control section 18*a*, 18*b*, 18*c* sends commands to the respective steering control section 21*a*, 21*b*, 21*c* to achieve the requested vessel yaw or rotation. Movement of the joystick 22 out of its vertical position effectively engages a "joystick mode" wherein the control circuit 14 controls operation and positioning of the marine propulsion devices 16*a*, 16*b*, 16*c* based upon movement of the joystick 22. In another example, "joystick mode" can be actuated by user input to the keypad 28 or other input device.

Through experimentation, the inventors have determined that lateral maneuvering capabilities of marine vessels are often limited by the relatively lower thrust capabilities of the one of the port or starboard propulsion device that is operating in the reverse gear. Such systems often cannot efficiently utilize the maximum thrust capacity of the forwardly operating device while still achieving the requested lateral thrust vector. This is because propellers generally provide less thrust in reverse than forward. This becomes a serious problem in cases where a large lateral thrust is necessary to achieve a lateral movement of the vessel.

In the exemplary embodiment shown in FIGS. 1 and 2, the joystick 22 is operable to request lateral movement, of the marine vessel 12 with respect to the longitudinal axis L. Lateral movement can be understood to be any movement of the vessel 12 in a direction that is not parallel to the longitudinal direction L. In the exemplary embodiment, the lateral movement R (FIG. 2) that is requested is normal to the longitudinal direction L; however other lateral movements could be requested and acted upon according to the concepts of the present disclosure. When joystick mode is initiated, or when the lateral movement is requested by the user, the control circuit 14 controls orientation of the port and starboard propulsion devices 16*a*, 16*b* inwardly as shown so as to create propulsive thrusts along respective axes that intersect at a common point on the marine vessel 12, which in the example shown is the center of turn of the marine vessel 12. In other examples, the common point could be for example the center of gravity of the marine vessel or some other common point. The control circuit 14 further operates one of the port and starboard propulsion devices 16*a*, 16*b* in forward gear so as to apply a forward thrust vector on the marine vessel 12. The other of the port and starboard propulsion devices 16*a*, 16*b* is operated in reverse gear so as to provide a reverse thrust vector on the marine vessel 12. As shown, the propulsive thrusts on the marine vessel 12 extend along axes that are transverse to the longitudinal axis L.

In the example shown in FIG. 2, the joystick 22 is operated to achieve the port lateral movement R that is normal to the longitudinal axis L. In this example, the control circuit 14 controls the starboard propulsion device 16*b* into forward gear to provide a forward effective thrust vector on the marine vessel 12, as shown by arrow B. The control circuit 14 also controls the port device 16*a* into reverse gear so as to apply a reverse thrust vector on the marine vessel 12, as shown at arrow A. It will be understood by those having ordinary skill in the art that requests by the joystick 22 for lateral movement in different directions will effect different shift and thrust commands to the propulsion devices 16*a*, 16*b* to achieve such a lateral movement. For example, the thrust vectors A and B shown in FIG. 2 would be oppositely oriented for a request for opposite (i.e. starboard) lateral movement of the marine vessel 14 normal to the longitudinal axis L.

As shown in FIG. 2, upon initiation of joystick mode, or upon a request for lateral movement of the marine vessel 12, the control circuit 14 controls orientation of the intermediate propulsion device 16*c* into alignment (i.e. parallel) with the longitudinal axis L. The intermediate propulsion device 16*c* is thus oriented so as to provide a resultant thrust vector C on the vessel 12 that is aligned with the same common point (here the center of turn 29) to which the port and starboard propulsion devices 16*a*, 16*b* are oriented. The control circuit 14, upon the request for lateral movement from the joystick 22, controls the intermediate propulsion device 16*c* into reverse gear to apply a reversely acting thrust vector C on the marine vessel 12. In contrast to systems which maintain the intermediate propulsion device 16*c* in neutral gear upon a request for lateral movement of the vessel 12, the present inventors have recognized that operating the intermediate propulsion device 16*c* in reverse gear allows for application of a larger forward thrust vector (e.g. B in this example) by the forwardly operating propulsion device (e.g. 16*b* in this example), while still achieving the requested lateral movement (R in this example). That is, the thrust vectors shown by arrows A, B, and C, together result in a net lateral force vector R that is in a direction and of a magnitude was requested by the user. Stated another way, the thrust vectors A, B and C each have y-components $y_1$, $y_2$, and $y_3$ respectively. The y-components are equalized such that $$y_1=y_2+y_3$$

Summation of the respective x-components of the thrust vectors A, B and C results in the vector R being applied on the marine vessel in the X-direction. This in turn achieves more responsive movement of the vessel 12 in the lateral direction. By operating the intermediate propulsion device 16*c* in the reverse gear, the control circuit 14, based upon the request for lateral movement from the input device or joystick 22, can control the one of the port and starboard propulsion devices 16*a*, 16*b* to apply a forward propulsive force that is greater than a maximum potential reverse propulsive force of the other of the port and starboard propulsion devices 16*a*, 16*b*. This provide substantial performance advantages over the prior art.

In the example described herein above, the increased thrust provided by the respective devices 16*a*, 16*b*, 16*c* will not result in any yaw of the vessel 12 because the port, starboard and intermediate propulsion devices are all oriented towards the common point, which in the example shown is the center of turn 29 of the marine vessel 12. However, in another example, if a further request for lateral movement of the marine vessel 12 is received from the input device or joystick 22 that is greater than a speed of movement that can be achieved by the orientation of the propulsion devices 16*a*, 16*b*, 16*c* shown in FIG. 2, the control circuit 14 optionally can be programmed to incrementally control the orientation of the port and starboard devices so as to create propulsive thrusts along axes that are angled further aftwardly with respect to (i.e. away from) the common point (which in this example is the center of turn of the marine vessel 12). This disadvantageously creates yaw of the marine vessel 12 about its center of turn 29; however, it will ultimately achieve the requested lateral movement of the vessel 12. Once the lateral movement, is complete, the system can optionally be programmed to further correct the yaw orientation of the vessel 12 by operating the propulsion devices 16*a*, 16*b*, 16*c* according to known station keeping modes for marine vessels. In another example, the control circuit 14 optionally can be programmed to increase the lateral movement of the marine vessel 12 by maintaining the intermediate propulsion device 16*b* in the reverse gear and increasing the throttle of the intermediate propulsion device 16*b* and the one of the port and starboard propulsion devices 16*a*, 16*b* that is operating in the forward gear. This increases the translation and adds reverse movement of the vessel without yaw. Once the lateral movement is complete, the system can optionally be programmed to further correct the undesired movement.

Figure 7:
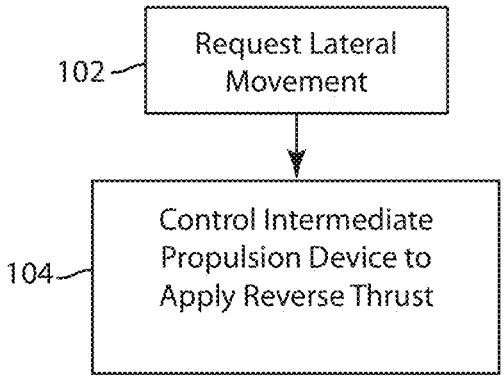
FIG. 7 is a flowchart depicting one example of a method of maneuvering a marine vessel.

FIG. 7 shows one example of a method for maneuvering a marine vessel. At step 102, a lateral movement is requested of the marine vessel with respect to the longitudinal axis. At step 104, a control circuit controls an intermediate propulsion device in a plurality of propulsion devices to apply a thrust that results in a reverse thrust vector on the marine vessel.

Figure 8:
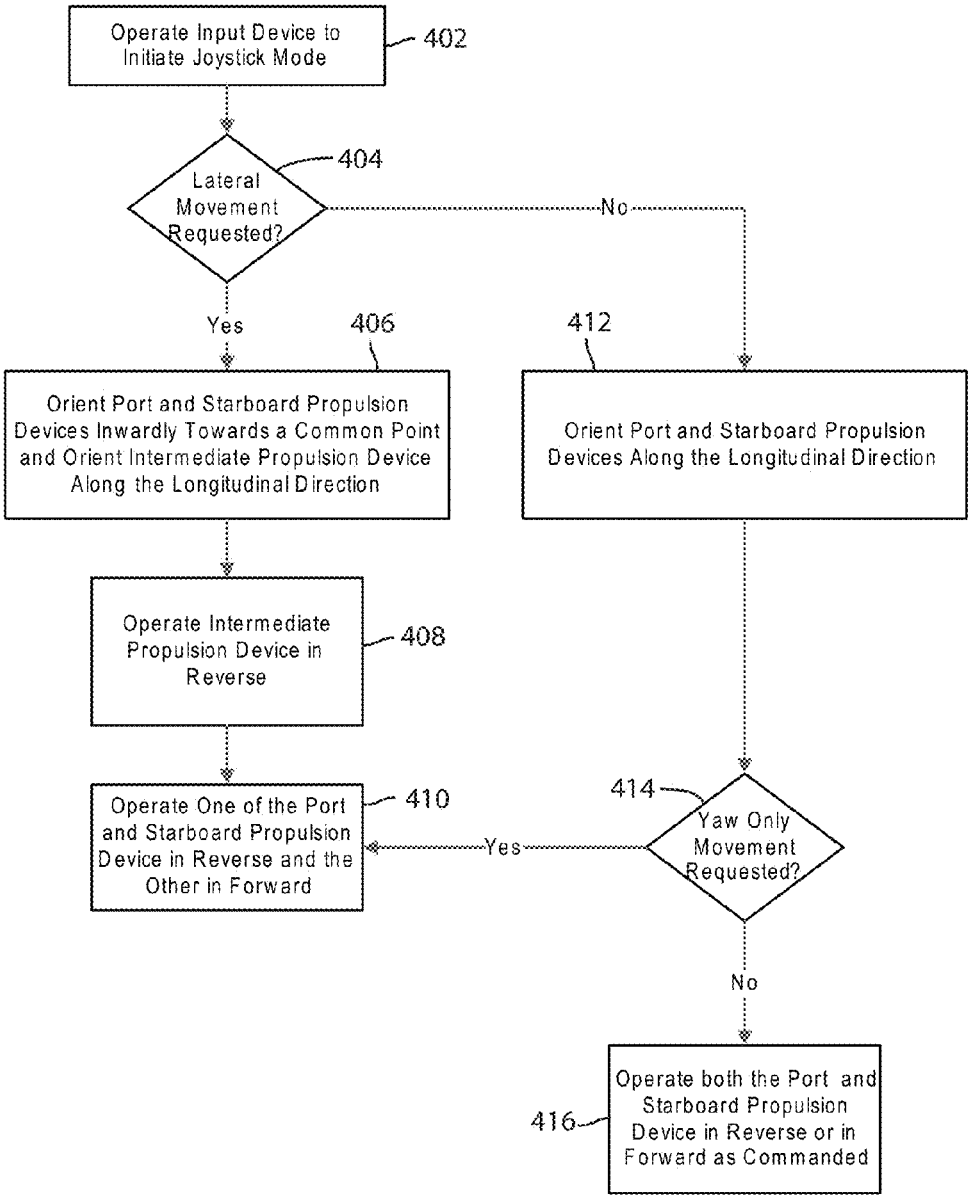
FIG. 8 is flow chart depicting another example of a method of maneuvering a marine vessel.
Figure 9:
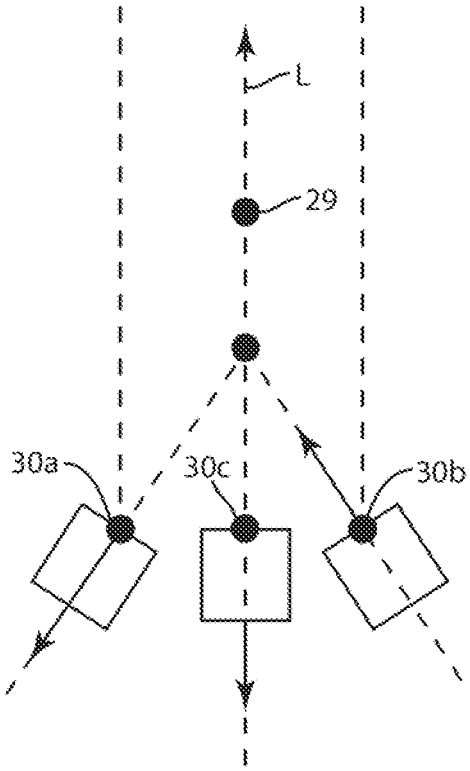
FIG. 9 is a schematic depiction wherein port and starboard devices are oriented further inwardly, away from the common point, as compared to FIG. 2.

FIG. 8 depicts another example of a method for maneuvering a marine vessel. At step 402, an input device is operated to initiate joystick mode. At step 404, the control circuit determines whether a lateral movement has been requested. If yes, at step 406, the control circuit orients the port and starboard propulsion devices inwardly towards a common point and orients the intermediate propulsion device along the longitudinal direction. At step 408, the control circuit operates the intermediate propulsion device in reverse gear and at step 410, operates one of the port and starboard propulsion devices in reverse gear and the other in forward gear. If at step 404, it is determined that lateral movement is not requested, at step 412, the control circuit orients the port and starboard propulsion devices along the longitudinal direction. At step 414, the control circuit determines whether a yaw-only movement has been requested, for example by rotation of the handle of the joystick. If yes, the control circuit follows step 410, described above. If no, at step 416, the control circuit operates both the port and starboard propulsion devices in reverse or in forward, as requested by the input device.

What is claimed is:

1. A system for maneuvering a marine vessel, the vessel having a longitudinal centerline, the system comprising:

an input device requesting, lateral movement of the marine vessel with respect to the longitudinal centerline;

a plurality of propulsion devices comprising at least a port propulsion device, a starboard propulsion device, each having forward and rear ends, wherein the intermediate propulsion device is disposed on the longitudinal centerline device disposed between the port and starboard propulsion devices, and wherein the intermediate propulsion device is rotatable about a steering axis located on the longitudinal centerline; and a control circuit that controls orientation of the forward ends of the port and starboard propulsion devices inwardly towards the longitudinal centerline so as to create propulsive thrusts along axes that intersect at a common point along the longitudinal centerline, and upon a request for lateral movement from the input device, operates one of the port and starboard propulsion devices in forward gear, operates the other of the port and starboard propulsion devices in reverse gear, and operates the intermediate propulsion device in reverse gear.

2. The system according to claim 1, wherein upon the request for lateral movement, the control circuit controls orientation of the intermediate propulsion device so as to create propulsive thrust that is parallel to the longitudinal centerline and controls orientation of the port and starboard propulsion devices so as to create propulsive thrusts along axes that are transverse to the longitudinal centerline.

3. The system according to claim 2, wherein the control circuit, based upon the request for lateral movement from the input device, operates the one of the port and starboard propulsion devices in forward gear to apply a propulsive thrust that is greater than a maximum potential propulsive thrust of the other of the port and starboard propulsion devices in reverse gear.

4. The system according to claim 3, wherein the port, starboard and intermediate propulsion devices are oriented so that substantially zero moment is applied to the marine vessel.

5. The system according to claim 4, wherein the common point is a center of turn of the marine vessel.

6. The system according to claim 5, wherein the input device comprises a joystick.

7. The system according to claim 1, wherein the control circuit, based upon the request for lateral movement from the input device, operates the one of the port and starboard propulsion devices in forward gear to apply a propulsive thrust that is greater than a maximum potential propulsive thrust of the other of the port and starboard propulsion devices in reverse gear.

8. The system according to claim 1, wherein the port, starboard and intermediate propulsion devices are oriented so that substantially zero moment is applied to the marine vessel.

9. The system according to claim 1, wherein the common point is a center of turn of the marine vessel.

10. The system according to claim 9, wherein the control circuit, based on a further request for lateral movement that is greater than a speed of movement that can be achieved by a present setting of the port, starboard, and intermediate propulsion devices, increases throttle of the intermediate propulsion device in the reverse gear and increases throttle of the one of the port and starboard propulsion devices in the forward gear.

11. The system according to claim 1, wherein the control circuit, based on a further request for lateral movement that is greater than a speed of movement that can be achieved by a current orientation of the port, starboard, and intermediate propulsion devices, controls the orientation of the port and starboard propulsion devices so as to create propulsive thrusts along axes that are angled further aftwardly with respect to the common point.

12. The stem according to claim 1, wherein the input device comprises a joystick.

13. A marine vessel extending along a longitudinal axis having a longitudinal centerline, the marine vessel comprising:

an input device for requesting lateral movement of the marine vessel with respect to the longitudinal axis;

a plurality of propulsion devices comprising at least a port propulsion device, a starboard propulsion device, each having forward and rear ends, wherein the intermediate propulsion device is disposed on the longitudinal centerline device disposed between the port and starboard propulsion devices, wherein the intermediate and propulsion device is rotatable about a steering axis located on the longitudinal centerline; and a control circuit that controls orientation of the forward ends of the port and starboard propulsion devices inwardly towards the longitudinal centerline so as to create propulsive thrusts along axes that intersect at a common point, controls one of the port and starboard propulsion devices to apply a forward thrust on the marine vessel, controls the other of the port and starboard propulsion devices to apply a reverse thrust on the marine vessel, and, upon a request for lateral movement from the input device, controls the intermediate propulsion device to apply a reverse thrust on the marine vessel.

14. The marine vessel according to claim 13, wherein the control circuit controls orientation of the intermediate propulsion device so as to create a propulsive thrust that is parallel to the longitudinal centerline and controls the orientation of the port and starboard propulsion devices so as to create propulsive thrusts along axes that are transverse to the longitudinal centerline.

15. The marine vessel according to claim 14, wherein the control circuit controls the one of the port and starboard propulsion devices to apply a forward propulsive thrust that is greater than a maximum potential reverse propulsive thrust of the other of the port and starboard propulsion devices.

16. The marine vessel according to claim 15, wherein the port, starboard and intermediate propulsion devices are oriented so that zero moment is applied to the marine vessel.

17. The marine vessel according to claim 15, wherein the control circuit, based on a further request for lateral movement that is greater than a speed of movement that can be achieved by a current orientation of the port, starboard, and intermediate propulsion devices, controls the orientation of the port and starboard propulsion devices so as to create propulsive thrusts along axes that are aligned further aftwardly with respect to the common point.

18. The system according to claim 17, wherein the control circuit, based on a further request for lateral movement that is greater than a speed of movement that can be achieved by a present setting of the port, starboard, and intermediate propulsion devices, increases throttle of the intermediate propulsion device in the reverse gear and increases throttle of the one of the port and starboard propulsion devices in the forward gear.

19. The marine vessel according to claim 13, wherein the control circuit controls the one of the port and starboard propulsion devices to apply a forward propulsive thrust that is greater than a maximum potential reverse propulsive thrust of the other of the port and starboard propulsion devices.

20. The marine vessel according to claim 13, wherein the port, starboard and intermediate propulsion devices are oriented so that zero moment is applied to the marine vessel.

* * * * *

UNITED STATES PATENT AND TRADEMARK OFFICE

CERTIFICATE OF CORRECTION

PATENT NO. : 8,807,059 B1
APPLICATION NO. : 13/227578
DATED : August 19, 2014
INVENTOR(S) : William J. Samples et al.

It is certified that error appears in the above-identified patent and that said Letters Patent is hereby corrected as shown below:

In the Claims:

Col. 10, Lines 22-44 should read
Claim 1. A system for maneuvering a marine vessel, the vessel having a longitudinal centerline, the system comprising:

an input device requesting, lateral movement of the marine vessel with respect to the longitudinal centerline;

a plurality of propulsion devices comprising at least a port propulsion device, a starboard propulsion device <u>and an intermediate propulsion device</u>, each having forward and rear ends, wherein the intermediate propulsion device is disposed on the longitudinal centerline ~~device disposed~~ between the port and starboard propulsion devices, and wherein the intermediate propulsion device is rotatable about a steering axis located on the longitudinal centerline; and a control circuit that controls orientation of the forward ends of the port and starboard propulsion devices inwardly towards the longitudinal centerline so as to create propulsive thrusts along axes that intersect at a common point along the longitudinal centerline, and upon a request for lateral movement from the input device, operates one of the port and starboard propulsion devices in forward gear, operates the other of the port and starboard propulsion devices in reverse gear, and operates the intermediate propulsion device in reverse gear.

Col. 11, Lines 27-28 should read
Claim 12. A ~~stem~~ system according to claim 1, wherein the input device comprises a joystick.

Cols. 11-12, Lines 29-6 should read
Claim 13. A marine vessel extending along a longitudinal axis having a longitudinal centerline, the marine vessel comprising:

an input device for requesting lateral movement of the marine vessel with respect to the longitudinal axis;

a plurality of propulsion devices comprising at least a port propulsion device, a starboard propulsion device <u>and an intermediate propulsion device</u>, each having forward and rear ends, wherein Signed and Sealed this
Twenty-first Day of October, 2014

Michelle K. Lee

Michelle K. Lee
*Deputy Director of the United States Patent and Trademark Office* the intermediate propulsion device is disposed on the longitudinal centerline ~~device disposed~~ between the port and starboard propulsion devices, and wherein the intermediate and propulsion device is rotatable about a steering axis located on the longitudinal centerline; and a control circuit that controls orientation of the forward ends of the port and starboard propulsion devices inwardly towards the longitudinal centerline so as to create propulsive thrusts along axes that intersect at a common point, controls one of the port and starboard propulsion devices to apply a forward thrust on the marine vessel, controls the other of the port and starboard propulsion devices to apply a reverse thrust on the marine vessel, and, upon a request for lateral movement from the input device, controls the intermediate propulsion device to apply a reverse thrust on the marine vessel.

Col. 12, Lines 30-37 should read

Claim 18. The ~~system~~ marine vessel according to claim 17, wherein the control circuit, based on a further request for lateral movement that is greater than a speed of movement that can be achieved by a present setting of the port, starboard, and intermediate propulsion devices, increases throttle of the intermediate propulsion device in the reverse gear and increases throttle of the one of the port and starboard propulsion devices in the forward gear.